US012377891B2

(12) United States Patent
Fernandes

(10) Patent No.: US 12,377,891 B2
(45) Date of Patent: Aug. 5, 2025

(54) COMMUNICATIONS BETWEEN END OF TRAIN DEVICES AND HEAD OF TRAIN DEVICES ON MULTIPLE TRAINS

(71) Applicant: Siemens Mobility, Inc., New York, NY (US)

(72) Inventor: Mario Fernandes, Jacksonville, FL (US)

(73) Assignee: Siemens Mobility, Inc., New York, NY (US)

( * ) Notice: Subject to any disclaimer, the term of this patent is extended or adjusted under 35 U.S.C. 154(b) by 958 days.

(21) Appl. No.: 17/446,508

(22) Filed: Aug. 31, 2021

(65) Prior Publication Data

US 2023/0063525 A1 Mar. 2, 2023

(51) Int. Cl.

| | |
|---|---|
| ***B61L 15/00*** | (2006.01) |
| ***B61L 25/02*** | (2006.01) |
| ***B61L 27/70*** | (2022.01) |

(52) U.S. Cl.

CPC ..... *B61L 15/0027* (2013.01); *B61L 15/0054* (2013.01); *B61L 25/025* (2013.01); *B61L 27/70* (2022.01); *B61L 2205/02* (2013.01); *B61L 2205/04* (2013.01)

(58) Field of Classification Search

CPC ..... B61L 15/0027; B61L 15/0054; B61L 27/00; B61L 25/025; B61L 2205/02; B61L 2205/04

See application file for complete search history.

(56) References Cited

U.S. PATENT DOCUMENTS

| | | | | |
|---|---|---|---|---|
| 6,322,025 | B1 * | 11/2001 | Colbert | B61L 15/0036 340/505 |
| 2003/0214417 | A1 * | 11/2003 | Peltz | B61L 25/028 340/4.3 |
| 2005/0004722 | A1 * | 1/2005 | Kane | B61L 15/0054 701/19 |
| 2007/0120417 | A1 * | 5/2007 | Root | B60T 7/16 303/3 |
| 2007/0236079 | A1 * | 10/2007 | Kull | B60T 17/228 303/7 |
| 2008/0149781 | A1 * | 6/2008 | Root | B60T 17/228 246/167 R |
| 2008/0243320 | A1 * | 10/2008 | Otsubo | G08C 25/00 701/19 |
| 2010/0130124 | A1 * | 5/2010 | Teeter | B61L 15/0027 455/15 |
| 2010/0213321 | A1 * | 8/2010 | Kane | B61L 25/025 246/167 R |

(Continued)

FOREIGN PATENT DOCUMENTS

| | | | | |
|---|---|---|---|---|
| WO | WO-2018139998 | A1 * | 8/2018 | B60T 13/665 |
| WO | WO-2019240767 | A1 * | 12/2019 | B61L 15/0054 |

*Primary Examiner* — Jason C Smith

(57) ABSTRACT

An electronic train device suitable of use on a railway vehicle includes a radio module configured, through operation of at least one processor, to support and monitor a plurality of communication channels for messages transmitted between multiple electronic train devices on multiple railway vehicles, and to repeat and/or route a transmitted message using a channel of the plurality of communication channels to provide reliable communication between the multiple electronic train devices.

10 Claims, 5 Drawing Sheets

(56) References Cited

U.S. PATENT DOCUMENTS

| | | | | |
|---|---|---|---|---|
| 2014/0277859 | A1* | 9/2014 | Morris | B61L 15/0054 701/19 |
| 2016/0068173 | A1* | 3/2016 | Fuchs | B61L 15/0027 340/994 |
| 2016/0096538 | A1* | 4/2016 | Bartek | B61L 27/70 246/28 R |
| 2017/0088153 | A1* | 3/2017 | Fernandes | B61L 15/009 |
| 2020/0353961 | A1* | 11/2020 | Bonnes | G01S 19/50 |
| 2022/0097743 | A1* | 3/2022 | Bolte | B60T 13/665 |
| 2022/0194443 | A1* | 6/2022 | Covari | H02J 7/14 |
| 2022/0281496 | A1* | 9/2022 | Fernandes | B61L 27/40 |
| 2023/0063525 | A1* | 3/2023 | Fernandes | B61L 15/0027 |
| 2023/0065249 | A1* | 3/2023 | Fernandes | H04W 4/029 |
| 2023/0202538 | A1* | 6/2023 | Fernandes | B61L 15/0027 246/167 R |
| 2023/0242163 | A1* | 8/2023 | Swar | H01Q 21/28 246/167 R |

* cited by examiner

COMMUNICATIONS BETWEEN END OF TRAIN DEVICES AND HEAD OF TRAIN DEVICES ON MULTIPLE TRAINS

BACKGROUND

1. Field

Aspects of the present disclosure generally relate to communications between end of train devices and head of train devices, specifically between end of train devices and head of train devices that assist other end of train devices and head of train devices located on nearby trains.

2. Description of the Related Art

Within the railway industry, an end of train device, herein also referred to as EOT, is an electronic device which performs a number of functions, some of which are required by regulations of the Federal Railroad Administration (FRA). The EOT is typically attached at a rear of a last car on a railway vehicle or train, often to an unused coupling on an end of the last car opposite a head of the train.

EOTs were originally designed to perform some of the functions previously performed by train personnel located in the caboose, thereby allowing trains to operate without a caboose and with a reduced number of train personnel. For example, an EOT can monitor air pressure in the air brake pipe and transmit this information to a head of train device, herein also referred to as HOT. A head of train device is attached at a first car on the train, for example a locomotive, opposite the EOT. Further, EOTs also often include an end-of-train marker light to alert trailing trains on the same track of the presence of the end of the train. Two-way EOTs can accept commands from the HOT, for example to open a valve to release pressure in the air brake pipe so that the train's air brakes activate to stop the train in an emergency. EOTs and HOTs can comprise many other components and/or functions.

Since EOTs and HOTs communicate from one end of the train to the other, they may experience communication failures due to length and composition of the train, as well as due to unfavorable terrain conditions, track layout, vegetation, and environmental factors. As railroads operate longer and longer trains, communication between EOT and HOT become less reliable, causing more frequent comms failures leading to train delays and loss of productivity.

SUMMARY

Briefly described, aspects of the present disclosure generally relate to communications between end of train devices, herein also referred to as EOT, and head of train devices, herein also referred to as HOT, in connection with multiple railroad vehicles. Specifically, aspects of the present disclosure relate to communications between end of train devices and head of train devices that assist other end of train devices and head of train devices located on nearby trains. The EOTs and HOTs are suitable for railway vehicles such as freight trains and passenger trains.

A first aspect of the present disclosure provides an electronic train device suitable of use on a railway vehicle comprising a radio module configured, through operation of at least one processor, to support and monitor a plurality of communication channels for messages transmitted between multiple electronic train devices on multiple railway vehicles, and repeat a transmitted message using at least one channel of the plurality of communication channels to provide reliable communication between the multiple electronic train devices.

A second aspect of the present disclosure provides an automatic train communications system comprising a first electronic train device located on a first train, a second electronic train device located on a second train, wherein the first electronic train device comprises a radio module configured, through operation of at least one processor, to support and monitor a plurality of communication channels for messages transmitted by the second electronic train device on the second train, and repeat a message transmitted by the second electronic train device using at least one channel of the plurality of communication channels.

DETAILED DESCRIPTION

To facilitate an understanding of embodiments, principles, and features of the present disclosure, they are explained hereinafter with reference to implementation in illustrative embodiments. In particular, they are described in the context of flexible multi-channel communication between multiple electronic train devices, such as for example EOT and a HOT, in connection with multiple railway vehicles.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
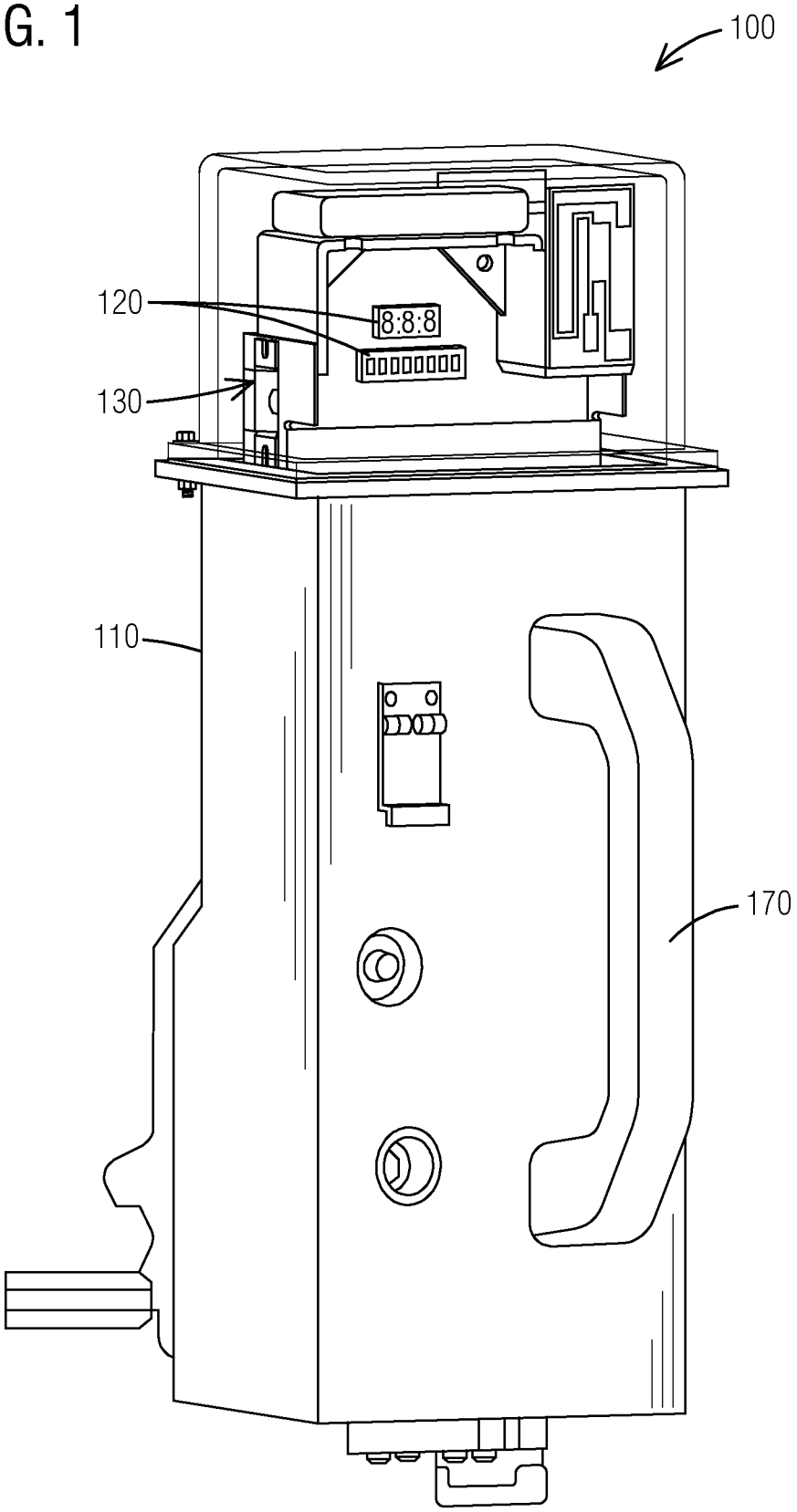
FIG. 1 illustrates a perspective view of an end of train device (EOT) in accordance with an exemplary embodiment of the present disclosure.

FIG. 1 illustrates a perspective view of an EOT 100 in accordance with an exemplary embodiment of the present disclosure. The EOT 100 is suitable of use on a railway vehicle located on a last train car of the railway vehicle, for example a freight train. The EOT 100 comprises an enclosure 110, and a plurality of components, such as electronic components, positioned inside the enclosure 110. For example, one or more displays 120 are positioned inside the enclosure 110. The one or more displays 120 display information and/or data provided by the EOT 100. An important component of the EOT 100 is a high visibility marker light (HVM) 130 which is utilized to illuminate a rearward of the railway vehicle. The EOT 100 further comprises a coupling unit (not visible in FIG. 1), typically attached to the housing 110, which couples the EOT 100 to the last train car, for example a train car coupling.

Examples of other components of the EOT 100 include cell phone transceivers, systems for monitoring/controlling brake lines and pressure, communication systems for communicating with other units, such as for example HOTs etc. The EOT 100 further comprises a handle 170 attached to the housing 110 for handling such as installation and removal of the EOT 100 on/off a train car of a railway vehicle, in particular a last train car. It should be noted that one of ordinary skill in the art is familiar with structure, components and functions of different types of EOTs, and they will not be described in further detail herein.

On the other hand, a head of train device (HOT) can be integrated into locomotive cab electronics or can be a standalone or console mounted unit. When used with an EOT, the HOT provides the locomotive engineer with important information regarding operation of the train. These conditions include brake pipe pressure and various status conditions. The EOT transmits data via a telemetry link, for example radio-based telemetry, to the HOT in the locomotive.

As described earlier, since EOTs and HOTs communicate from one end of the train to the other, they may experience communication failures due to length and composition of the train, as well as due to unfavorable terrain conditions, track layout, vegetation, and environmental factors. As railroads operate longer and longer trains, communication between EOT and HOT become less reliable, causing more frequent comms failures leading to train delays and loss of productivity.

Today, telemetry repeaters are used in locations where communications are known to be compromised. Also, in certain trains, a locomotive placed in the middle of the composition may be equipped with a repeater that helps bridge gap(s) between the HOT and EOT on that train. The use of strategically placed repeaters is only effective where these devices are installed.

Figure 2:
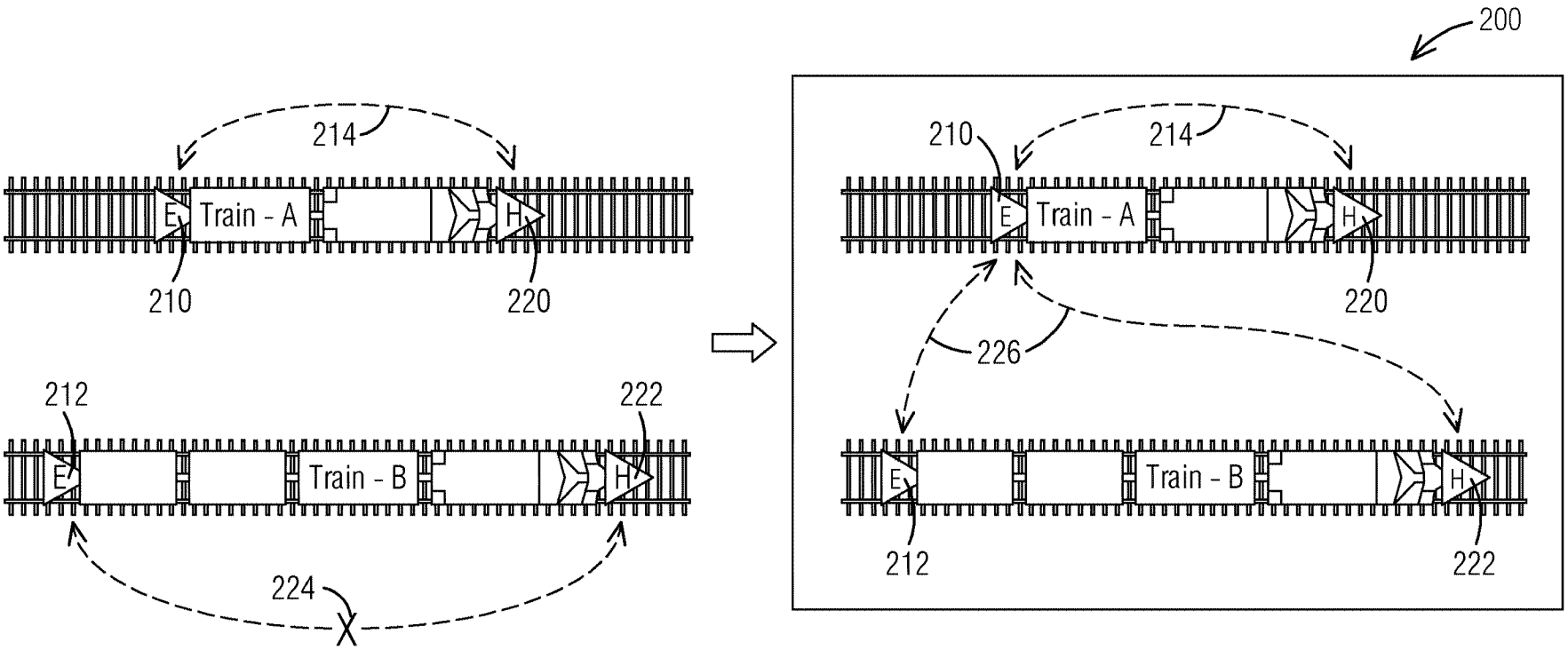
FIG. 2 and FIG. 3 illustrate first and second embodiments of a communications system for multiple electronic train devices on multiple railway vehicles in accordance with exemplary embodiments of the present disclosure.
Figure 3:
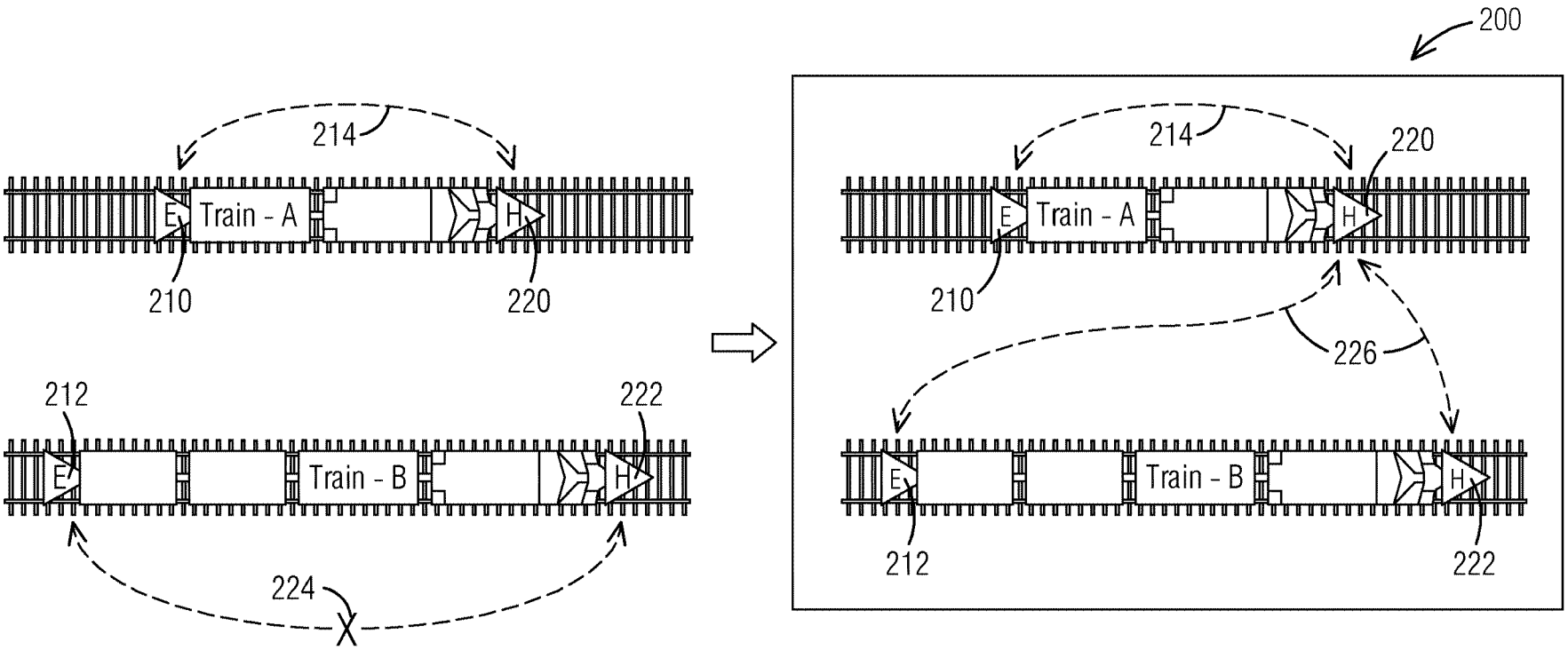

FIG. 2 and FIG. 3 illustrate first and second embodiments of a communications system 200 for multiple electronic train devices on multiple railway vehicles in accordance with exemplary embodiments of the present disclosure.

Generally, communication system 200 comprises multiple electronic train devices which include EOTs 210, 212 and HOTs 220, 222, located on multiple different trains TRAIN-A and TRAIN-B. EOTs 210, 212 can be configured for example as described with reference to FIG. 1.

EOTs 210, 212 are attached at a rear of a last car on railway vehicles TRAIN-A, TRAIN-B. HOTs 220, 222 are located opposite the EOTs 210, 212, for example at locomotives of TRAIN-A, TRAIN-B. A pair of EOT and HOT (EOT 210-HOT 220 and EOT 212-HOT 222) are in communication with each other, for example transmitting and/or receiving messages, information, commands, or signals (also known as telemetry messages). A typical HOT 220, 222 comprises several lights indicating telemetry status and rear end movement, along with a digital readout of brake line pressure from the EOT 210, 212. HOT 220, 222 further includes means, for example a switch, for initiating an emergency brake application from the rear end. HOT 220, 222 can be built into the locomotive's computer system and information is displayed on a computer screen. In an example, the HOT 220, 222 can be integrated into a Positive Train Control (PTC) system of the railway vehicle, e.g. TRAIN-A, TRAIN-B, specifically in the locomotive.

Depicted on left sides of FIG. 2 and FIG. 3 is a successful communication between EOT 210 and HOT 220 of TRAIN-A, indicated by dashed line 214. However, EOT 212 and HOT 222 of TRAIN-B do not communicate successfully and experience communication failures or gaps, indicated by cross 224, for example due to a length of TRAIN-B.

With references to right sides of FIG. 2 and FIG. 3, in an exemplary embodiment of the present disclosure, the electronic train devices of TRAIN-A, e.g. EOT 210 and HOT 220, are equipped with repeating and/or routing functionality. Specifically, EOT 210 and HOT 220 are configured such that they are capable of repeating telemetry messages between EOT 212 and HOT 220 on nearby train TRAIN-B. Thus, a pair of EOT-HOT assists another pair of EOT-HOT on another train when in range or nearby. In range or nearby means that the assisting EOT and/or HOT is close enough to the EOT and/or HOT of the other train to be able to monitor communication channel(s) for incoming messages and to repeat those messages within the respective communication channel.

In an embodiment, repeating functionality is incorporated into EOT 210 and HOT 220 through use of an advanced radio capable of fast channel swapping so that multiple channels (at least 2 channels) are monitored for incoming messages simultaneously. Typically, HOT 220, 222 transmits messages to EOT 210, 212 via a first frequency channel, while EOT 210, 212 transmits messages to HOT 220, 222 via a second frequency channel. The advanced radio, of EOT 210 and/or HOT 220, is configured such that the advanced radio monitors the first frequency channel and second frequency channel used for telemetry messaging between EOT 212 and HOT 222. A message detected on either channel can then be re-transmitted (repeated) to its intended destination.

With this added capability, EOT 210 and/or HOT 220 are able to play the role of a repeater, in addition to their normal responsibilities, and assist with communications between HOTs and EOTs on other adjacent or nearby trains that may be experiencing communications failures, such as HOT 222 and EOT 212 on TRAIN-B. This enhanced function, where EOT 210 and/or HOT 220 on one train (TRAIN-A) may engage and assist EOT 212 and/or HOT 222 on another train (TRAIN-B) results in benefits in different scenarios.

For example, and with reference to FIG. 2, repeating capability of EOT 210 of TRAIN-A assists in communications of TRAIN-B. Specifically, EOT 210 is capable of monitoring communication channels between EOT 212 and HOT 222 of TRAIN-B for any messages and repeating/re-transmitting those messages via communication channel(s) 226. EOT 210 can assist because EOT 210 is nearby (in range) to TRAIN-B. Telemetry/communication distances, see dashed lines 226, between EOT 212-EOT 210 and EOT 210-HOT 222 are shorter than communication distance between EOT 212 and HOT 222 of TRAIN-B. As indicated by lines 226 with arrows at both ends, repeating and re-transmitting of telemetry messages is possible in both directions, that is from EOT 212 to HOT 222, via EOT 210, and vice versa.

In another example, with respect to FIG. 3, HOT 220 (instead of EOT 210) comprises repeating capability. In this example, HOT 220 of TRAIN-A assists with communications of TRAIN-B. It should be noted that, with reference to FIG. 2 and FIG. 3, both EOT 210 and HOT 220 of TRAIN-A may comprise repeating capabilities. EOT 210 and HOT 220 comprising repeating functionality will be described in more detail with respect to FIG. 5.

Figure 4:
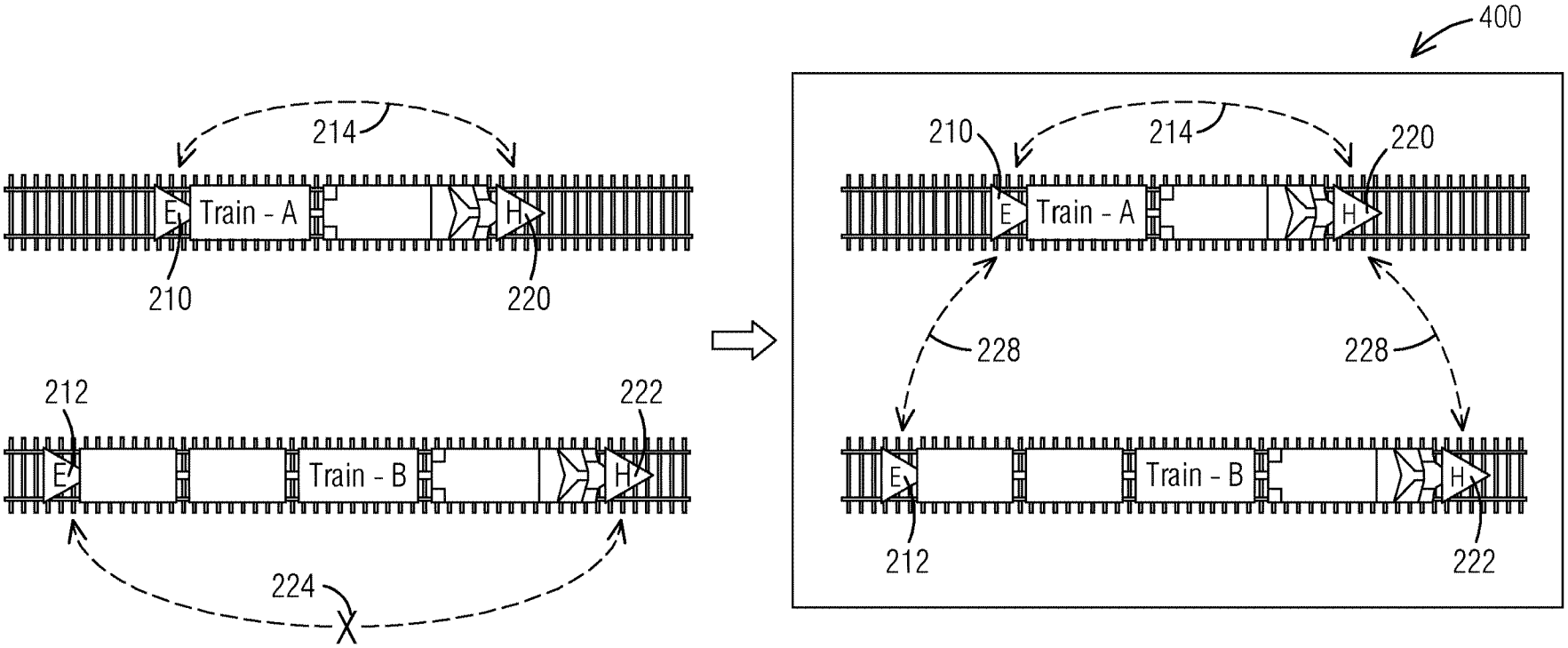
FIG. 4 illustrates a third embodiment of a communications system for multiple electronic train devices on multiple railway vehicles in accordance with an exemplary embodiment of the present disclosure.

FIG. 4 illustrates a third embodiment of a communications system 400 for multiple electronic train devices on multiple railway vehicles in accordance with an exemplary embodiment of the present disclosure.

In an exemplary embodiment, EOT 210 and HOT 220 of TRAIN-A comprise repeating and message routing capabilities which help forward and deliver messages between EOT 212 and HOT 222 of TRAIN-B. In this scenario, telemetry messages of TRAIN-B, sent by EOT 212 or HOT 222, are routed via EOT 210-HOT 220 of TRAIN-A. This means that telemetry messages of TRAIN-B are routed and repeated via EOT 210 and HOT 220 of TRAIN-A.

For example, EOT 212 of TRAIN-B may send a telemetry message via a first frequency channel, wherein EOT 210 of TRAIN-A monitors the first frequency channel and routes the message to HOT 220 of TRAIN-A. HOT 220 of TRAIN-A routes (which may include repeat) this message to be received by HOT 222 of TRAIN-B. The routing of the message between EOT 210 and HOT 220 may be done via the first frequency channel used by TRAIN-B or via a different frequency channel. The message is then routed to HOT 222 of TRAIN-B via the first frequency channel used by TRAIN-B. As indicated by dashed lines 228 with arrows, routing, which may include repeating, of messages is possible in both directions, that is from EOT 212 to HOT 222, via EOT 210-HOT 220, and vice versa.

Figure 5:
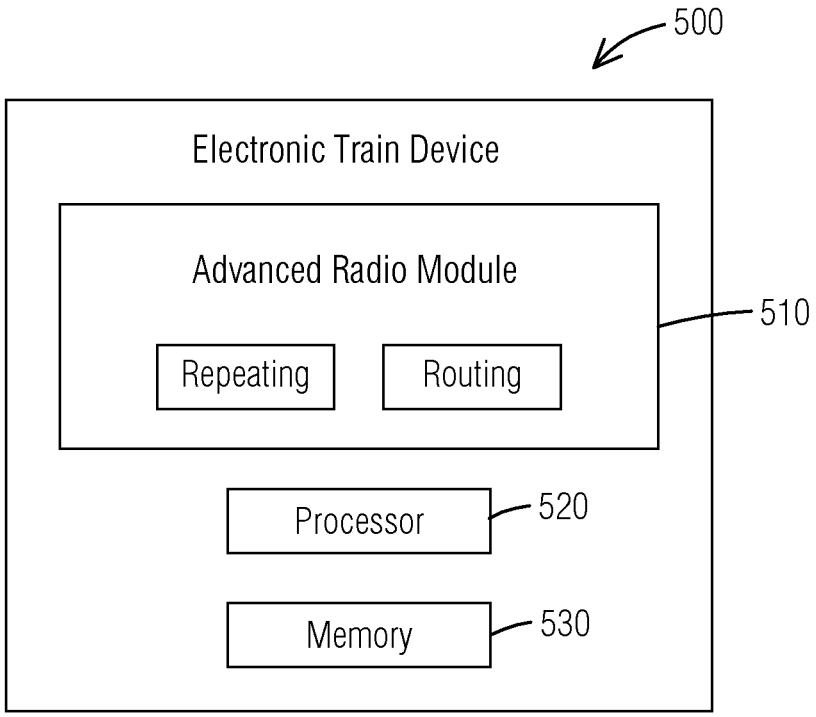
FIG. 5 illustrates a schematic of an electronic train device, such as EOT or HOT, with repeating/routing functionality in accordance with an exemplary embodiment of the present disclosures.

FIG. 5 illustrates a schematic of an electronic train device 500 with repeating functionality and/or routing functionality in accordance with an exemplary embodiment of the present disclosures.

In accordance with an exemplary embodiment of the present disclosure, electronic train device 500, such as for example EOT 210 or HOT 220, suitable of use on a railway vehicle, comprises an advanced radio module 510, at least one processor 520 and at least one memory 530. The radio module 510 is configured, through operation of processor 520, to support and monitor a plurality of communication channels for telemetry messages transmitted between multiple electronic train devices, and to repeat and/or route a transmitted message using at least one channel of the plurality of communication channels to provide reliable communication between the multiple electronic train devices.

In exemplary embodiments, the memory 530 may include a wide variety of memory devices including volatile and non-volatile memory devices, and the processor 520 may include one or more processing units. The memory 530 includes software with a variety of applications, programs, or computer executable instructions.

In an embodiment of the present disclosure, the advanced radio module 510 is configured, through operation of the processor 520, to swap between multiple communication channels. Specifically, the radio module 510 is capable of fast channel swapping so that multiple, for example two, channels can be monitored for telemetry messages simultaneously.

The radio module 510 may be embodied as software or a combination of software and hardware. The radio module 510 may be a separate module or may be an existing module programmed to perform a method as described herein. For example, the radio module 510 may be incorporated, for example programmed, into an existing device or module, such as device 500, e.g. EOT 210 or HOT 220, by means of software.

In an exemplary embodiment of the present disclosure, the radio module 510 is configured as software-defined radio, herein also referred to as SDR. Specifically, the electronic train device 500 is equipped with an SDR supporting multiple communication protocols, frequencies, and paths, to allow assistance with communications of other electronic train devices on other trains that are nearby or in range.

In addition to repeating and routing of telemetry messages as described herein, the electronic train device 500, e.g. EOT 210, HOT 220, equipped with the advanced radio module 500 are further configured and able to transport and deliver other information to nearby HOT and EOT devices, such as firmware upgrades, back-office commands and statuses, or cloud-server commands and statuses. The electronic train device 500 with repeating/routing capabilities is further configured and able to relay additional information, such as high-precision global navigation satellite system (GNSS) corrections, such as RTK (real time kinematic) corrections, PPP (precise point positioning) corrections and PPP-RTK corrections to other EOTs and HOTs in the vicinity.

By adding an advanced single-radio module with repeating and/or routing function to a HOT or EOT, opportunities for assisting communications on other trains are greatly expanded. It provides possibilities for managing and sharing of different types of information from one device to another, and from back-office servers or cloud servers to devices in the field.

It should be appreciated that acts associated with the above-described methodologies, features, and functions (other than any described manual acts) may be carried out by one or more data processing systems, such as for example radio module 510, via operation of at least one processor 520. As used herein, a processor corresponds to any electronic device that is configured via hardware circuits, software, and/or firmware to process data. For example, processors described herein may correspond to one or more (or a combination) of a microprocessor, CPU, or any other integrated circuit (IC) or other type of circuit that is capable of processing data in a data processing system.

The radio module 510 and/or processor 520 that is described or claimed as being configured to carry out a particular described/claimed process or function may correspond to a CPU that executes computer/processor executable instructions stored in a memory in form of software and/or firmware to carry out such a described/claimed process or function. However, it should also be appreciated that such a processor may correspond to an IC that is hard wired with processing circuitry (e.g., an FPGA or ASIC IC) to carry out such a described/claimed process or function.

The invention claimed is:

1. An end of train device (EOT), comprising:

a radio module configured, through operation of at least one processor, to support and monitor a plurality of communication channels for messages transmitted between multiple electronic train devices on multiple railway vehicles, and repeat a transmitted message using at least one channel of the plurality of communication channels to provide communication between the multiple electronic train devices on the multiple railway vehicles, wherein the multiple electronic train devices include end of train devices and head of train devices, and a tracking device providing location data of the railway vehicle, wherein the tracking device comprises a global positioning system (GPS) receiver or a global navigation satellite system (GNSS) receiver, wherein the EOT including the radio module is located on a first railway vehicle, wherein the radio module is configured to detect messages on a second railway vehicle, wherein the radio module is configured to route and repeat detected messages from an end of train device or a head of train device of the second railway vehicle via the EOT of the first railway vehicle.

2. The EOT of claim 1, wherein the radio module is configured to route a transmitted message between the multiple electronic train devices and between the multiple railway vehicles.

3. The EOT of claim 1, wherein the radio module is configured to swap between communication channels such that multiple channels are monitored simultaneously.

4. The EOT of claim 1, wherein the plurality of communication channels comprises a plurality of frequency channels.

5. The EOT of claim 1, wherein the radio module is configured to relay high-precision global navigation satellite system (GNSS) corrections to the multiple electronic train devices.

6. An automatic train communications system comprising:

a first electronic train device configured as an end of train device (EOT) located on a first train, and a second electronic train device located on a second train, the second electronic train device being configured as EOT or head of train device (HOT), wherein the EOT comprises a tracking device providing location data of the first train, wherein the tracking device comprises a global positioning system (GPS) receiver or a global navigation satellite system (GNSS) receiver, wherein the EOT comprises a radio module configured, through operation of at least one processor, to support and monitor a plurality of communication channels for messages transmitted by the second electronic train device on the second train, and repeat a message transmitted by the second electronic train device using at least one channel of the plurality of communication channels, wherein the EOT including the radio module located on the first train is configured to detect messages on the second train, wherein the radio module is configured to route and repeat detected messages from the end of train device or the head of train device of the second train via the EOT of the first train.

7. The automatic train communications system of claim 6, wherein the radio module is configured to route the message to a third electronic train device on the first or second train.

8. The automatic train communications system of claim 6, wherein the radio module is configured to swap between communication channels such that multiple channels are monitored simultaneously.

9. The automatic train communications system of claim 6, wherein the plurality of communication channels comprises a plurality of frequency channels.

10. The automatic train communications system of claim 6, wherein the first electronic train device is configured to relay high-precision global navigation satellite system (GNSS) corrections to the second electronic train device.

* * * * *